United States Patent [19]

Keiji

[11] 3,980,201

[45] Sept. 14, 1976

[54] POP-TOP CAN LID

[76] Inventor: Taniuchi Keiji, No. 6-7, 2-chome, Nishi-Koujiya, Ohta, Tokyo, Japan

[22] Filed: Mar. 11, 1975

[21] Appl. No.: 557,391

[30] Foreign Application Priority Data

July 4, 1974 Japan ..... 49-78209

[52] U.S. Cl. ..... 220/270; 113/121 C

[51] Int. Cl.[2] ..... B65D 41/32

[58] Field of Search ..... 220/90.6, 270–273, 220/265, 266; 113/121 C, 15 A

[56] References Cited

UNITED STATES PATENTS

| | | | |
|---|---|---|---|
| 3,285,467 | 11/1966 | Moran | 220/273 |
| 3,563,199 | 2/1971 | Wolfe | 220/270 |
| 3,825,149 | 7/1974 | Brown et al. | 220/90.6 X |

*Primary Examiner*—George T. Hall

*Attorney, Agent, or Firm*—Lackenbach, Lilling & Siegel

[57] ABSTRACT

The periphery of a tearably detachable portion of a pop-top can lid is defined by a continuous folded wall which extends inwardly of the can lid, by which a sharp edge is formed inwardly of the can lid after the detachable portion is torn from the can lid and, thus, a person is prevented from injuries that would be otherwise caused by the sharp edge.

6 Claims, 5 Drawing Figures

POP-TOP CAN LID

The present invention relates in general to cans and, more, particularly, to the improvement over the lid of a pop-top can having a tearably detachable portion.

It is well known and popular to provide a beverage and other cans with pop-top lids. A continuous groove of suitable shape is cut in the surface of the lid to define a tearably detachable portion, and a handle or tab is riveted to the portion near the periphery thereof. The portion or pop-top is torn from the can by pulling the tab back across the surface of the portion.

A problem is encountered in the prior art pop-top can in that the can lid is formed with a continuous sharp edge at the periphery of the portion or pop-top when it is torn from the can lid. The sharp edge will frequently cause injuries to the lips of a person.

It is therfore an object of the present invention to provide an improved pop-top can lid which is free from danger of injuries to the lips of a person even when the pop-top is torn from the can lid.

It is another object of the present invention to provide an improved pop-top can lid having a tearably detachable portion which is easily torn from the can lid.

The above and other objects, features and advantages of the present invention will become more apparent from the following description when taken in conjunction with the accompanying drawings, in which.

Figure 1:
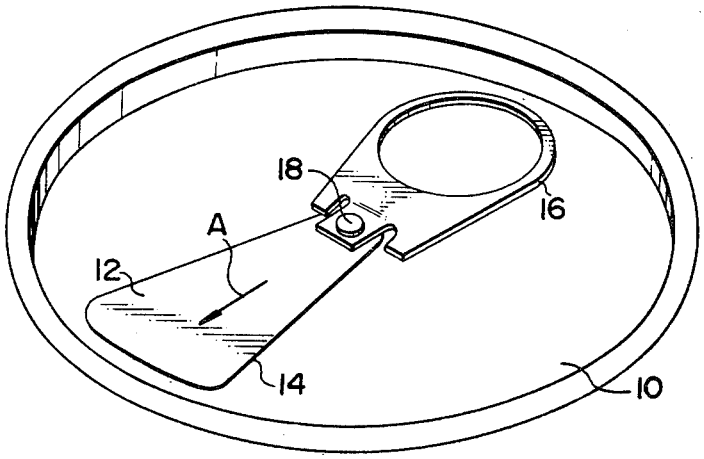
FIG. 1 is a perspective view illustrating an example of a pop-top can lid to which the present invention is applied.

Referring now to FIG. 1, there is schematically shown an example of a pop-top can lid 10 (the can is not shown). The pop-top can lid 10 is formed with a tearably detachable portion 12. The portion 12 may be of any desired shape, but is preferably of the shape shown which is known in the art. A handle or tab 16 formed with a hole (no numeral) is fastened to the portion near the periphery thereof by a rivet 18. A person desiring to open the can inserts a finger through the hole in the tab 16 and pulls the tab in the direction of an arrow A. This operation causes the attached portion 12 to be cleanly and easily torn from the remainder of the can lid 10.

Figure 2:
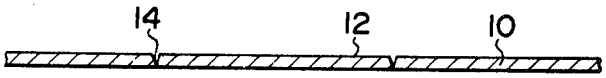
FIG. 2 is a fragmentary sectional view of a prior art pop-top can lid.
Figure 3:
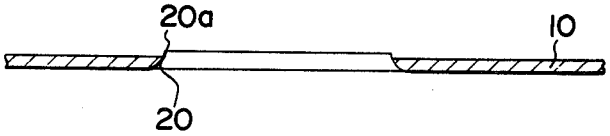
FIG. 3 is similar to FIG. 2, but shows the can lid in which the pop-top is torn from the can lid.

A prior art pop-top can lid is formed with a tearably detachable portion 12, which is defined by a continuous groove 14 as shown in FIG. 2. With the pop-top can lid thus formed, if the pop-top or the portion 12 is torn from the can lid 10, an outwardly extending sharp edge is formed at the periphery of the opening 20 and frequently causes injuries to the lips of the person when he puts the lips to the opening of the can.

Figure 4:
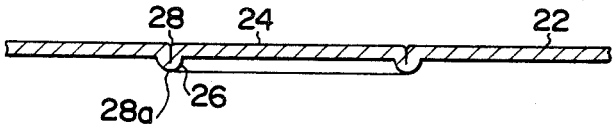
FIG. 4 is a fragmentary sectional view of a pop-top can lid according to the present invention.
Figure 5:
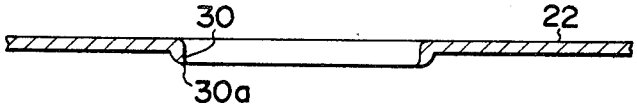
FIG. 5 is similar to FIG. 4, but shows the can lid in which the pop-top is torn therefrom.

The present invention contemplates to have the pop-top can lid formed with an improved tearably detachable portion by which the can is opened without an outwardly extending sharp edge that would otherwise cause injuries to the lips of the person. As shown in FIG. 4, a pop-top can lid 22 embodying the present invention has a tearably detachable portion 24, which is defined by a continuous folded wall 26 which extends inwardly of the can lid 22. A continuous groove 28 having V-shape in cross section is formed on the outer surface of the folded wall 26 and forms an weakened portion **28*a* at the periphery of the detachable portion 24 so that the portion 24 is easily torn from the can lid 22. It will be noted that the continuous folded wall 26 with the groove 28** formed therein is formed by pressing operation of upper and lower dies of suitable shapes, though not shown.

With the can lid thus formed, if the portion 24 is torn from the lid 22 to provide an opening 30, a continous sharp edge or an annular flange **30*a* is formed so as to extend inwardly of the can lid 22 and, thus, the lips of the person is free from contacting the sharp edge 30*a* of the opening 30**.

It will now be understood from the foregoing description that in accordance with the present invention the sharp edge is formed at the periphery of the opening of the can lid so as to extend inwardly of the lid and, accordingly, a person is prevented from injuries that would be otherwise caused by the sharp edge of the opening.

What is claimed is:

1. A safety pop-top can lid comprising a tearably detachable portion on the can lid which is severable therefrom along a tear line which defines the peripheral configuration of said detachable portion, said tear line comprising a continuous folded wall portion folded about a fold line, said wall portion extending inwardly of said can lid and having a generally V-shaped cross-section to form a pair of coextensive flange portions each of which is substantially normal to the plane of said can lid and has an inward-most end portion, said pair of flanges being joined to each other at said inward-most end portion thereof along said fold line, whereby severance of said detachable portion from said can lid along said fold line forms edges at a point most remote from said can lid, said edges remaining to be inwardly directed away from said can lid to minimize dangerous exposure of the flange edge which remains on the can lid after said detachable portion is removed.

2. A safety pop-top can lid as defined in claim 1, wherein said pair of flanges together define a continuous groove which opens outwardly of said can lid.

3. A safety pop-top can lid as defined in claim 1, wherein said folded wall portion is singly folded.

4. A safety pop-top can lid as defined in claim 1, further comprising a handle fastened to said tearably detachable portion.

5. A safety pop-top can lid comprising a tearably detachable portion on the can lid which is severable therefrom along a fold line which defines the periphery of said detachable wall portion, said detachable wall portion being joined to the can lid along a singly folded and inwardly directed wall portion which is substantially V-shaped in cross-section and which forms a continuous groove which opens in a direction normal to the plane of the can lid, said fold line being the most innermost end of said V-shaped folded wall portion which is most remote from the can lid.

6. A safety pop-top can lid as defined in claim 5, further comprising a handle fastened to said tearably detachable portion.

* * * * *

UNITED STATES PATENT OFFICE
CERTIFICATE OF CORRECTION

PATENT NO. : 3,980,201
DATED : September 14, 1976
INVENTOR(S) : Taniuchi Keiji

It is certified that error appears in the above-identified patent and that said Letters Patent are hereby corrected as shown below:

On the heading or cover page of the above patent, on the line identified by "[76] Inventor:", change the inventor's name from "Taniuchi Keiji" to --Keiji Taniuchi--.

Also, on the second line of the above noted page below the words "United States Patent [19]", change the name "Keiji" to --Taniuchi--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*